US008090125B2

(12) United States Patent
Zheng et al.

(10) Patent No.: US 8,090,125 B2
(45) Date of Patent: Jan. 3, 2012

(54) CONTACT TYPE ELECTRET CONDENSER PICKUP

(75) Inventors: Hu-Ming Zheng, Guangdong (CN); Zhi-Jian He, Guangdong (CN); Yi Ouyang, Guangdong (CN)

(73) Assignee: Transound Electronics Co., Ltd., Dongguan Quangdong (CN)

( * ) Notice: Subject to any disclaimer, the term of this patent is extended or adjusted under 35 U.S.C. 154(b) by 1173 days.

(21) Appl. No.: 11/840,927

(22) Filed: Aug. 17, 2007

(65) Prior Publication Data

US 2008/0063222 A1 Mar. 13, 2008

(30) Foreign Application Priority Data

Sep. 13, 2006 (CN) ..... 2006 2 0064135 U

(51) Int. Cl.
*H04R 25/00* (2006.01)

(52) U.S. Cl. ..... 381/178; 381/173; 381/174; 381/175; 381/176; 381/369

(58) Field of Classification Search ..... 381/173, 381/174, 175, 176, 369
See application file for complete search history.

(56) References Cited

U.S. PATENT DOCUMENTS

| | | | | |
|---|---|---|---|---|
| 6,208,237 | B1 * | 3/2001 | Saiki et al. | 340/388.1 |
| 6,810,128 | B2 * | 10/2004 | Kaneda et al. | 381/396 |
| 2006/0280320 | A1 * | 12/2006 | Song et al. | 381/174 |
| 2010/0061572 | A1 * | 3/2010 | Hibbing | 381/174 |

* cited by examiner

*Primary Examiner* — Thao Le
*Assistant Examiner* — Eric Jones

(57) ABSTRACT

A contact type electret condenser pickup to deliver high anti noise, top talking quality, and comprehensive range of applications includes a casing provided with an accommodation chamber to contain an O-ring, a vibration part, an insulation packing, a back plate retaining ring containing a back plate, a conductive connection ring, and a circuit board horizontally placed in sequence; vibration of a sound of a user is transmitted to the vibration part; then an inertia vibration of the metal sheet changes capacitance between the vibration part and the back plate; the changed vibration is converted through the circuit board set into voltage of alternating signals for output variable according to changes of vibration.

3 Claims, 9 Drawing Sheets

CONTACT TYPE ELECTRET CONDENSER PICKUP

BACKGROUND OF THE INVENTION (a) Field of the Invention

The present invention is related to a contact type electret condenser pickup, and more particularly, to one that contacts human skin to pick up micro vibration generated during talking to realize electro-acoustic transduction.

(b) Description of the Prior Art

How to maintain clear and effective communications in a highly noisy environment, e.g., fire fighting site or a battlefield has been a problem desperately to be solved. Currently, a contact type vibration pickup is usually used for electro-acoustic transducer essentially based on electromagnetic and piezoelectric working principle. Both types of the transducers however have been found with certain problems in their talking clarity, output sensitivity, and anti noise performance.

A condenser pickup of the prior art has a thinner metal diaphragm serving as a plate (a vibration part) of a condenser and a fixed thicker metal plate facing the diaphragm as a fixed plate of capacitance (back plate); an air medium existing between the vibration part and the back plate functions as a condenser; and an elastic structure of the thinner metal diaphragm is capable of picking up vibration of external acoustic wave to create minor axial displacement thus to change an air gap between the vibration part and the back plate resulting in changed capacity of electric charge of the condenser comprised of both plates. Changed electric charge resulted from changed acoustic pressure further change in output voltage, thus to avail a current in specific size and direction. A condenser pickup provides advantage of good frequency response, low noise level, and low distortion; and disadvantages of comparatively complicated output interface circuit, lower level of output signals, being vulnerable to interference by external stray signals, and preventing from forming a complete set with associate apparatus.

SUMMARY OF THE INVENTION

The primary purpose of the present invention is to provide a contact type electret condenser pickup that delivers high anti noise, top talking quality, and comprehensive range of applications.

To achieve the purpose, a contact type electret condenser pickup of the present invention includes an casing provided with an accommodation chamber to receive an O-ring, a vibration part, an insulation packing, a back plate retaining ring disposed with a back plate, a conductive connection ring, and a circuit board set in sequence; wherein, the O-ring, the vibration part, and the insulation packing jointly allow a space for the vibration part to realize vibration; the back plate is electrically connected to the circuit board set through the conductive connection ring; an open end of the casing is inwardly curved in radius towards the circuit board set and maintains constant contacts among the O-ring, the vibration part, the insulation packing, the back plate, the back plate retaining ring, and the conductive connection ring received in the casing.

The vibration part includes a metal sheet and a weight with the weight fixed to a side of the metal sheet in facing the O-ring; or alternatively the vibration part includes a support and a metal sheet with the metal sheet fixed to the support of the vibration part by means of a cantilever structure.

The casing may be made in a long and thin tube that allows it to be inserted into a human's acoustic meatus with the vibration part, the O-ring, the back plate, and the circuit board set overlapped and received in the accommodation chamber of the casing in a direction vertically to the open end of the casing.

Accordingly, the contact electret condenser pickup of the present invention has its vibration part to be made of a metal sheet fixed on the back of the metal sheet a weight or a metal sheet secured in position by means of a cantilever structure so to allow vibration of one's throat while talking to be transmitted to the vibration part; then an inertia vibration of the metal sheet changes capacitance between the vibration part and the back plate; the changed vibration is converted through the circuit board set into voltage of alternating signals for output variable according to changes of vibration. Whereas a thickness of the metal sheet is one thousand times of that of the vibration diaphragm, the metal sheet will not vibrate when subject to acoustic wave, meaning, the metal sheet is not affected by noise thus to provide sound insulation. When compared to the prior art, the present invention is not affected by noise, providing high noise resistance, top talking quality, and delivers a comprehensive range of applications.

DETAILED DESCRIPTION OF THE PREFERRED EMBODIMENTS

Figure 1:
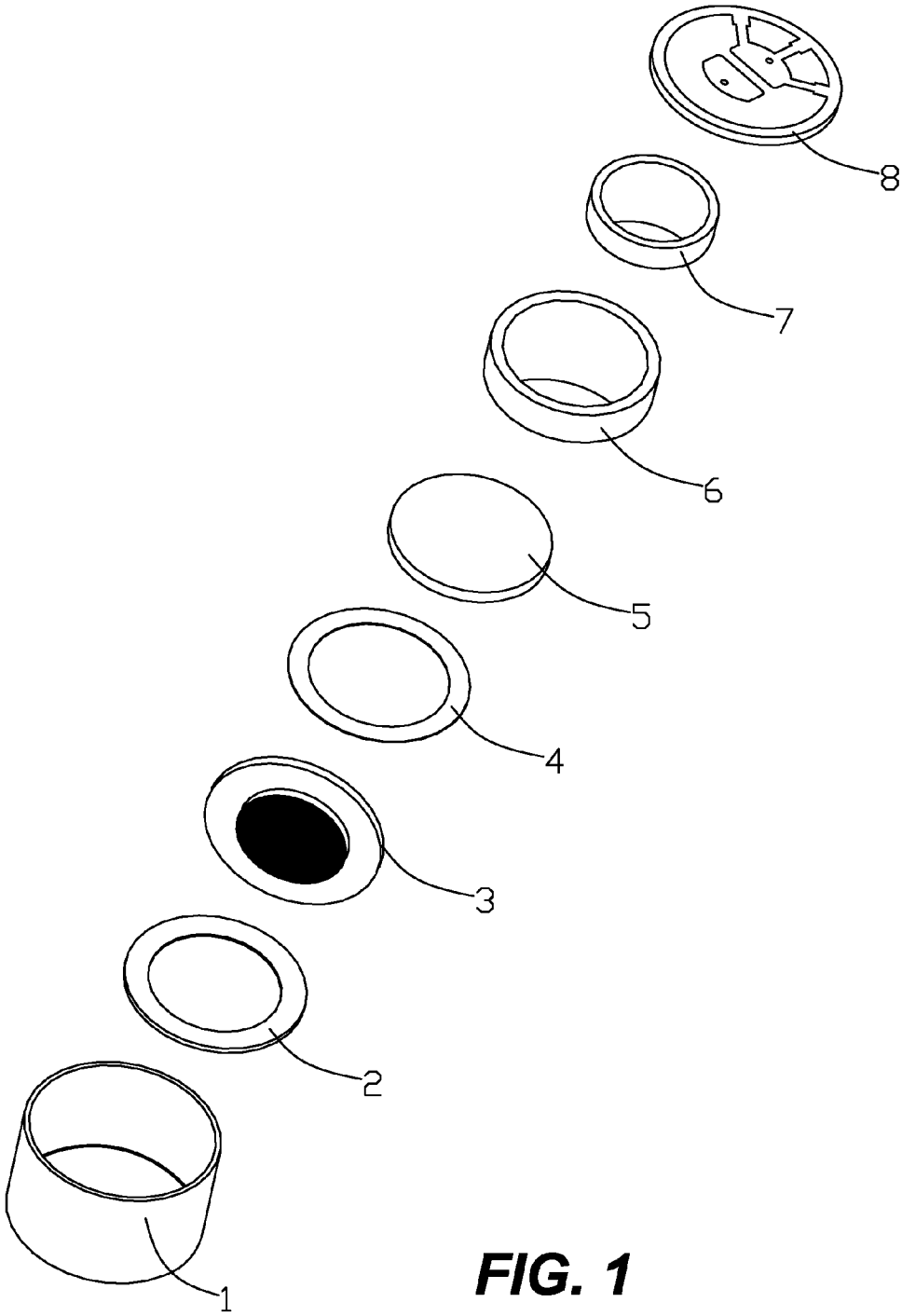
FIG. 1 is a perspective view of a first preferred embodiment of the present invention.
Figure 2:
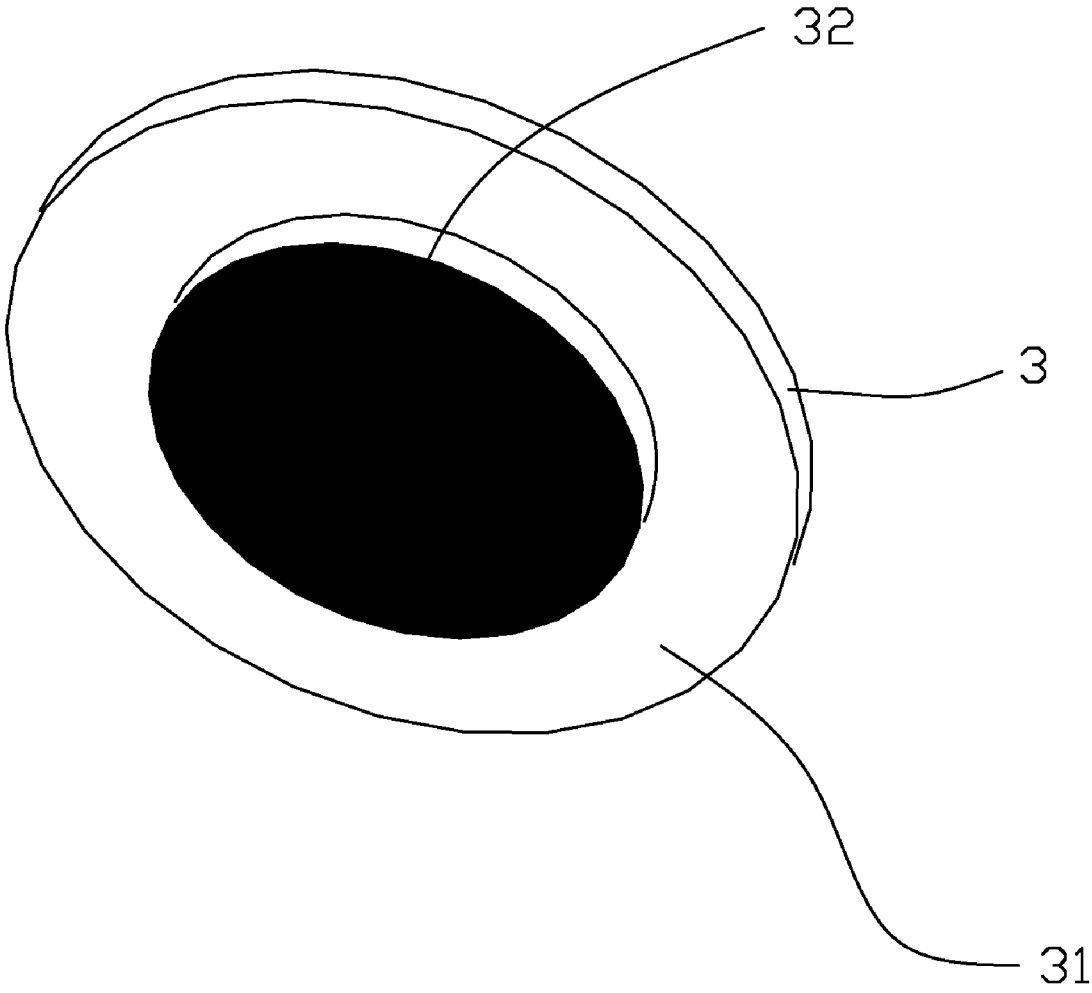
FIG. 2 is a schematic view showing a vibrating part of the first preferred embodiment of the present invention.
Figure 3:
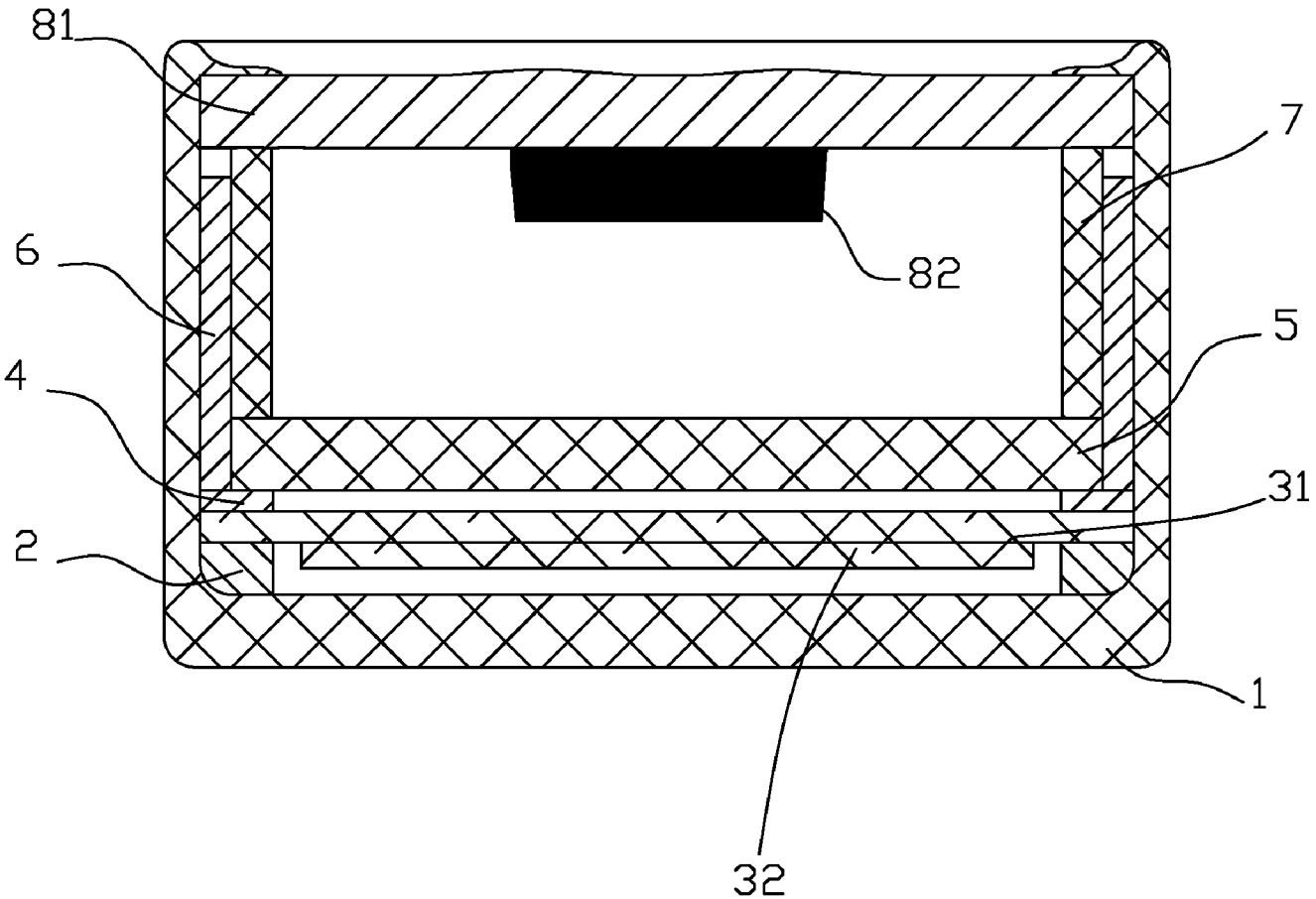
FIG. 3 is a sectional view showing the first preferred embodiment of the present invention.
Figure 4:
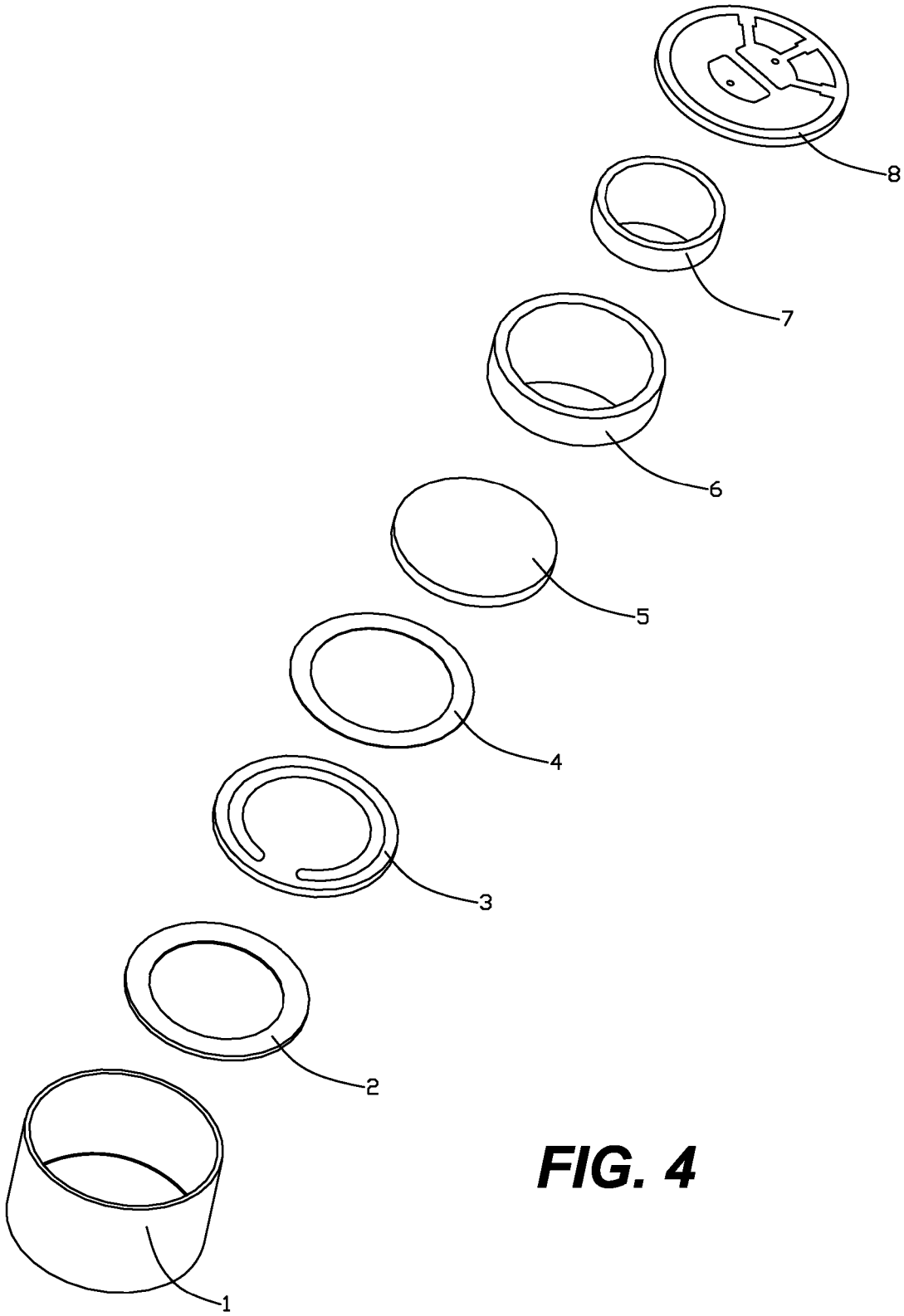
FIG. 4 is a perspective view of a second preferred embodiment of the present invention.
Figure 5:
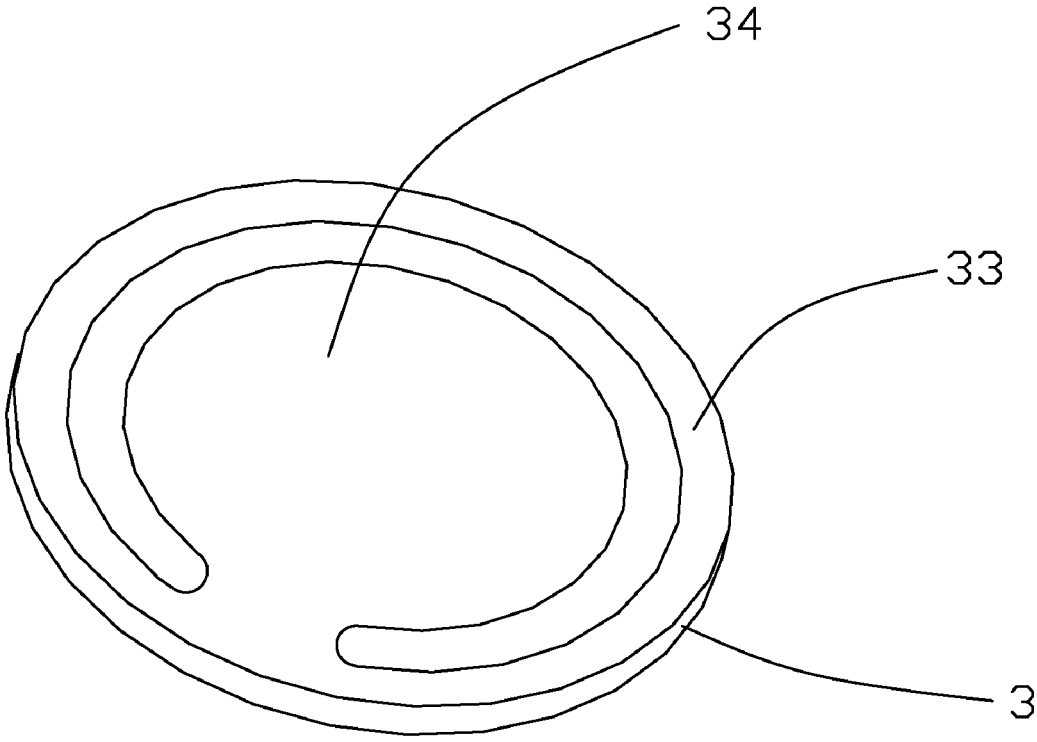
FIG. 5 is a schematic view showing a vibration part of the second preferred embodiment of the present invention.
Figure 6:
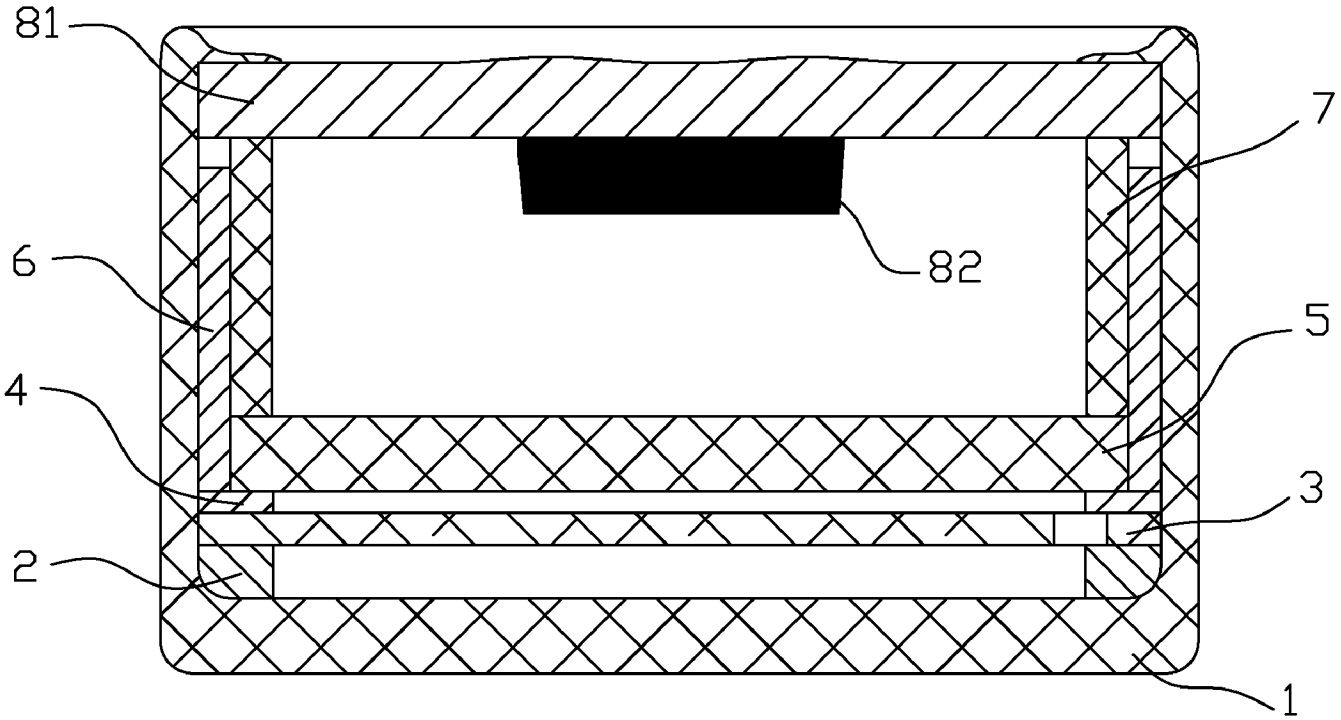
FIG. 6 is a sectional view showing the second preferred embodiment of the present invention.
Figure 7:
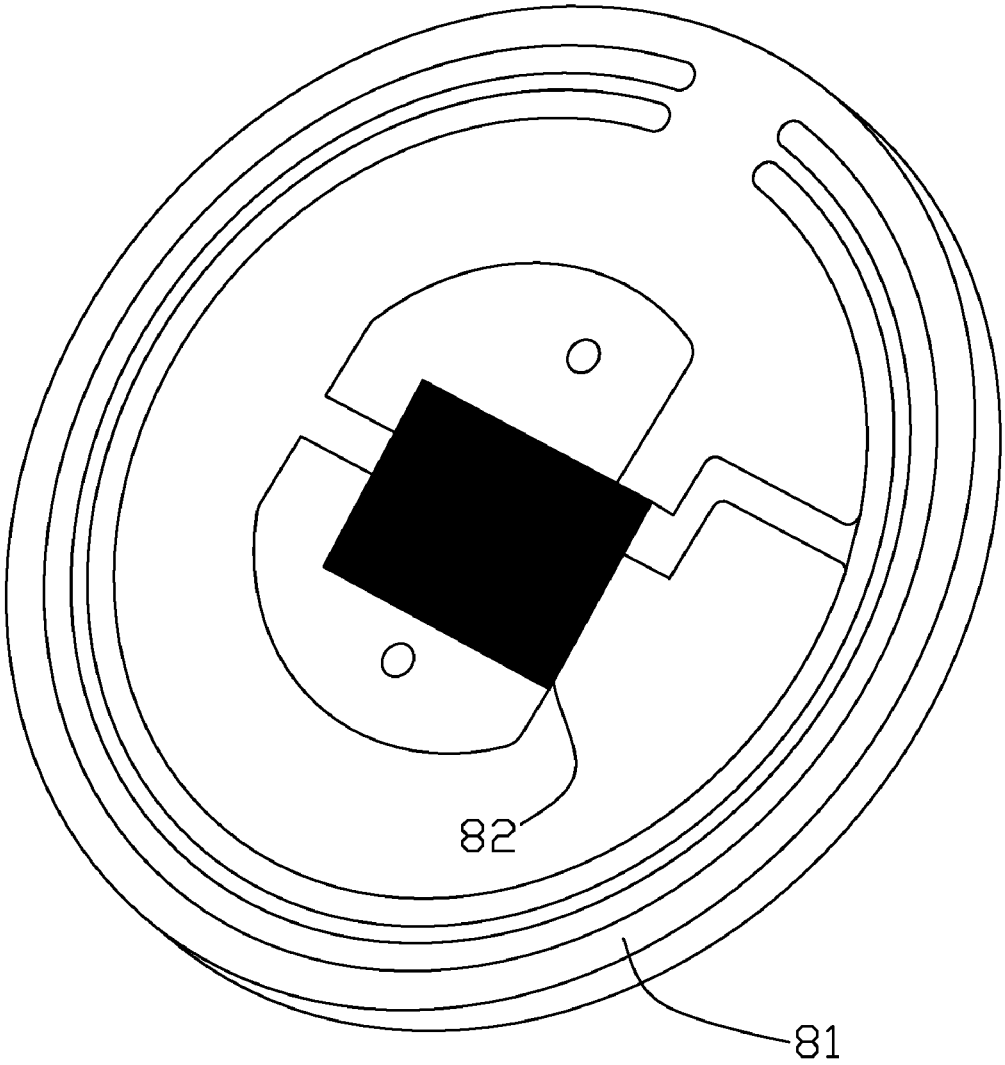
FIG. 7 is a schematic view showing a construction of a circuit board in the present invention.

Referring to FIGS. 1, 2, 3, and 7 for a first preferred embodiment of the present invention, a skin contact type electret condenser pickup is essentially comprised of a metal casing, an O-ring 2, a vibration part 3, an insulation packing 4, a back plate 5, a back plate retaining ring 6, a metal connection ring 7, and a circuit board set 8. The metal casing 1 is related to a cylindrical box with an open end. The O-ring 2 has an outer diameter to merely match with an inner diameter of the metal casing 1 and is placed in the metal casing 1 to contact an inner bottom of the metal casing 1.

The vibration part 3 includes a circular metal sheet 31 and a circular weight 32 with the weight 32 fixed to one side of the metal sheet 31; a diameter of the metal sheet 31 is merely matching with the inner diameter of the metal casing 1; the side of the metal sheet 31 fixed with the weight 32 is laterally placed on the O-ring; both circular cavities respectively of the weight 32 and the O-ring are placed corresponding to each other; and both of the metal sheet 31 and the weight 32 are pushed by the O-ring to stay clear out of the inner bottom of the metal casing 1. The insulating packing 4 placed on the metal sheet 31 is in an outer diameter to merely match with an inner diameter of the metal casing 1.

The back plate retaining ring 6 placed on the insulation packing 4 relates to a hollow cylindrical structure having an outer diameter to merely match with the inner diameter of the metal casing 1. The back plate 5 relates to a circular metal plate having one side attached with an electret thin diaphragm and a diameter matching with an inner diameter of the back plate retaining ring 6; the back plate is inserted in the back plate retaining ring 6 with the side attached with the diaphragm contacting the insulation packing 4; and both of the electret diaphragm and the metal sheet 31 keep a certain distance from each other by means of the insulation packing 4.

The metal connection ring 7 related to a hollow cylindrical structure has its outer diameter to merely match with the inner diameter of the back plate retaining ring 6 and is inserted into the back plate retaining ring 6 with one side contacting and electrically connecting to the back plate 5. The circuit board set 8 includes a circular circuit board 81 and a designated chip 82 attached to one side of the circuit board 81; the side of the circuit board 81 attached with the chip 82 contacts another side of the metal connection ring 7 and keeps electrically connected to the metal connection ring 7; the circuit board 81 has an outer diameter that is merely matching with the inner diameter of the metal casing 1; the metal casing 1 constitutes a cylindrical space in conjunction with the circuit board 81; and the opening end of the metal casing inwardly curved in radius towards the circuit board 81 and maintains constant contacts among the O-ring 2, the metal sheet 31, the insulation packing 4, the back plate 5, the back plate retaining ring 6, and the metal connection ring 7.

A second preferred embodiment of the present invention as illustrated in FIGS. 4, 5, 6, and 7 differs from the first preferred embodiment only in the vibration part 3. A vibration part 3 of the second preferred embodiment of the present invention is comprised of a circular support 33 and a circular metal sheet 34 secured to the circular support 33 by means of a cantilever structure; the metal sheet 34 is in a diameter smaller than an inner diameter of the circular support; the metal sheet 34 is located within a circular chamber of the circular support 33; and the metal sheet 34, the cantilever structure, and the circular support 33 are made an integral part using a circular metal plate in a punching process.

The present invention is also applicable to an ordinary condenser pickup Additional to both electret condenser pickups as disclosed in the first and the second preferred embodiments. When applied in the ordinary condenser pickup, it takes only to introduce a bias voltage through the circuit board into where between the vibration part and the back plate.

Figure 8:
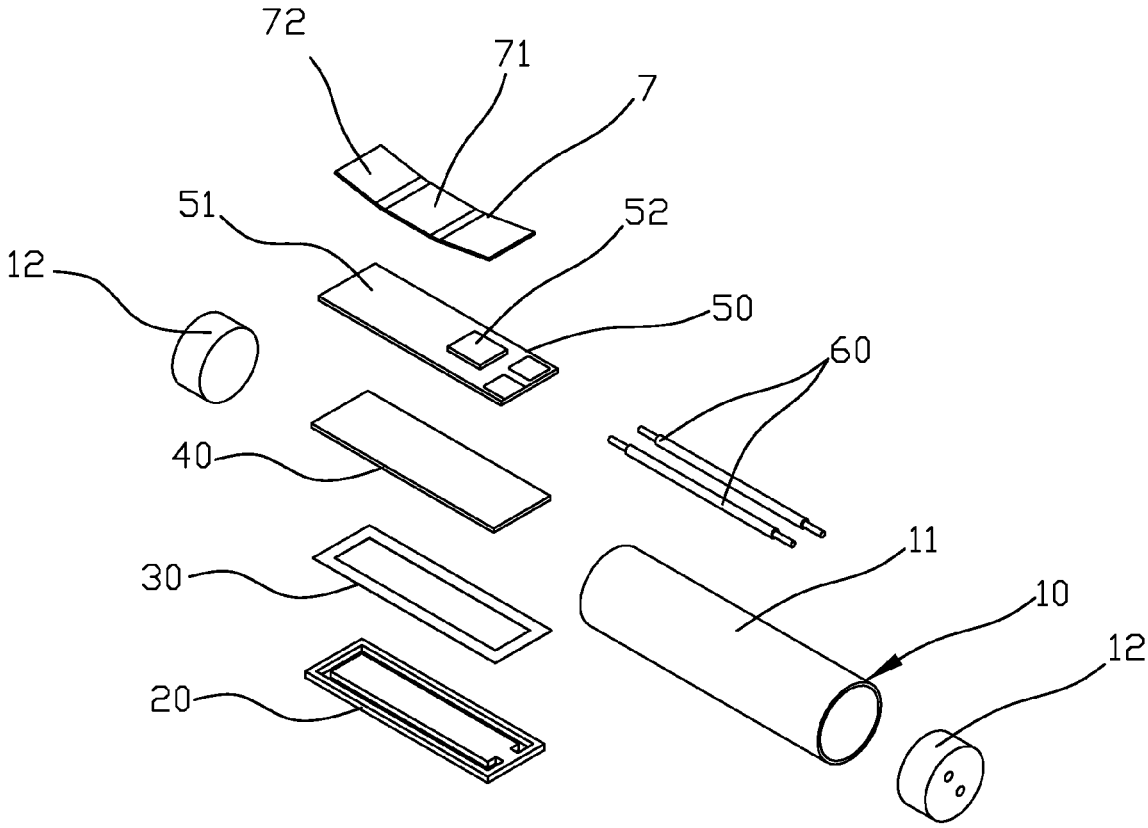
FIG. 8 is a perspective view of a third preferred embodiment of the present invention.
Figure 9:
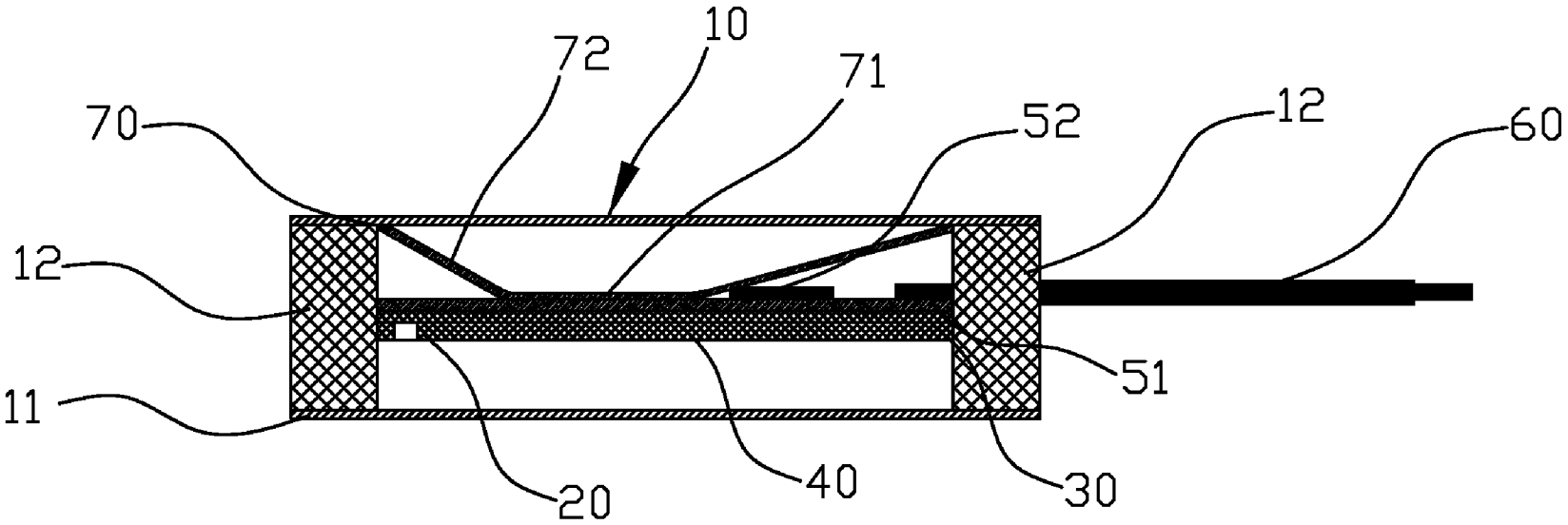
FIG. 9 is a schematic view showing a sectional view of the third preferred embodiment as assembled.

Now referring to FIGS. 8 and 9, a third preferred embodiment of the present invention made in a compact size that can be placed within a user;¦s acoustic meatus is comprised of a metal casing 10, a vibration part 20, a spacer 30, a back plate 40, a circuit board set 50, a lead wire 60, and a fastening elastic plate 70. Wherein, the metal casing 10 is related to a long and thin tube that allows it to be appropriately inserted into the user;¦s acoustic meatus; the vibration part 20, the spacer 30, the back plate 40, and the circuit board set 50 are laminated in sequence before being placed in an accommodation chamber 14 vertically along an open end 13 of a body 11 of the metal casing 10; the lead wire 60 is electrically connected to the circuit board set 50 and extends out of the metal casing 10 along a cap 12 on one end of the metal casing 10; the vibration part 2 is related to a rectangular or an oval beam structure of elastic cantilever; the back plate 40 is attached with an electret HD organic material; the spacer 30 is made of organic material with insulation property to become a condenser containing an air medium layer between the vibration part 20 and the back plate 40; the circuit board set 50 includes a circuit board 51 and a designated IC placed on the circuit board 51; and the fastening elastic plate 70 is disposed at where between the circuit board set 50 and an inner wall of the metal casing 10.

Accordingly, the vibration part 20, the spacer 30, the back plate 40, and the circuit board unit 50 are tightly laminated in sequence to ensure good contact among all members. The fastening elastic plate 70 is comprised of a press plate 71 compressing against the circuit board set 50 and two support arms 72 respectively extend from both ends of the press plate 71; and a top of each support arm 72 holds contacts the inner wall of the metal casing 10.

In the third preferred embodiment, the long and thin casing 10 receives in sequence the vibration part 20, the spacer 30, the back plate 40 and the circuit board set 50 laminated into an integral part to allow the casing to be placed into the user's acoustic meatus. Meanwhile, the vibration part 20, the spacer 30, the back plate 40 and the circuit board set 50 are inserted into a hollow chamber of the casing 10 in a direction vertical to an open end of the casing 10 to allow them to be placed in the user's acoustic meatus.

As the user talks, his/her cranium vibrates and a frequency of the vibration is transmitted to the vibration part for a dead load of the cantilever elastic structure of the vibration part 20 to pick up minute axial displacement thus to change an air gap between the vibration part and the back plate and further changes electric charge of the capacitance comprised of the vibration part and the back plate. Whereas capacitance is changed by the present invention without collecting sound waves, the present invention is not affective by any air-induced noise to provide high noise resistance and top talking quality.

The present invention is characterized in a condenser comprised of a vibration part and a back plate with variable gap to transmit a talking frequency of the user to the vibration part where picks up minute axial displacement crated by external vibration by means of an elastic cantilever structure or a metal sheet attached with a weight thus to change the air gap between the vibration part and the back plate, and further to change electric charge of a condenser comprised of the vibration part and the back plate to output alternating voltage. Consequently, the present invention is adaptable to various environment filled with higher level of noise including a fire fighting site and battlefield.

It is to be noted that the preferred embodiments disclosed in the specification and the accompanying drawings are not limiting the present invention; and that any construction, installation, or characteristics that is same or similar to that of the present invention should fall within the scope of the purposes and claims of the present invention.

We claim:

1. A contact type electret condenser pickup comprising a casing provided with an accommodation chamber to contain an O-ring, a vibration part, an insulation packing, a back plate retaining ring containing a back plate, a conductive connection ring, and a circuit board horizontally placed in sequence; the O-ring, the vibration part, and the insulation packing providing a space for the vibration part to realize vibration; the back plate being electrically connected to the circuit board set through the conductive connection ring; an open end of the casing inwardly curved in radius towards the circuit board set; the O-ring, the vibration part, the insulation packing, the back plate, the back plate retaining ring, and the conductive connection ring maintaining constant contacts in the casing; the vibration part being comprised of a support and a metal sheet; and the metal sheet being fixed to the support by means of a cantilever structure.

2. The contact type electret condenser pickup as claimed in claim 1, wherein the casing relates to one allowing proper insertion into a user's acoustic meatus; and the vibration part, the O-ring, the back place, the back plate, the insulation packing, and the circuit board set are laminated in sequence and placed in the accommodation chamber of the casing in a direction vertical to the open end of the casing.

3. The contact type electret condenser pickup as claimed in claim 1, wherein an electret diaphragm is attached to the back plate on one side corresponding to the vibration part.

* * * * *